United States Patent [19]

Vandame

[11] 4,273,975

[45] Jun. 16, 1981

[54] ELECTRIC CIRCUIT BREAKER

[75] Inventor: Philippe L. Vandame, Versailles, France

[73] Assignee: Nordic Finance and Trade (Panama) Ltd. Inc., Panama, Panama

[21] Appl. No.: 28,202

[22] Filed: Apr. 9, 1979

Related U.S. Application Data

[63] Continuation of Ser. No. 760,510, Jan. 19, 1977, abandoned.

[30] Foreign Application Priority Data

Jan. 20, 1976 [FR] France ..... 76 01443
Jan. 6, 1977 [FR] France ..... 77 00282

[51] Int. Cl.[3] ..... H01H 1/18; H01H 5/22

[52] U.S. Cl. ..... 200/67 C; 200/241; 200/250

[58] Field of Search ..... 200/67 D, 67 G, 67 C, 200/240, 241, 250, 260, 275, 283, 339, 68

[56] References Cited

U.S. PATENT DOCUMENTS

| | | | |
|---|---|---|---|
| 3,158,704 | 11/1964 | Sorenson | 200/67 G |
| 3,213,277 | 10/1965 | Heath | 200/67 C |
| 3,586,796 | 6/1971 | Simovits, Jr. et al. | 200/67 G X |
| 3,588,402 | 6/1971 | Heath | 200/67 G |
| 3,670,121 | 6/1972 | Howe | 200/67 G |
| 3,879,592 | 4/1975 | Comerford et al. | 200/339 X |
| 4,006,526 | 2/1977 | Vidalin | 200/67 G X |

FOREIGN PATENT DOCUMENTS

| | | | |
|---|---|---|---|
| 250445 | 3/1964 | Australia | 200/68 |
| 2224749 | 1/1973 | Fed. Rep. of Germany | 200/68 |
| 99948 | 7/1961 | Netherlands | 200/67 G |
| 911469 | 11/1962 | United Kingdom | 200/67 G |

*Primary Examiner*—Stephen Marcus

[57] ABSTRACT

The circuit breaker comprises a case, a rocking lever pivotally mounted in the case, said rocking lever having at least one sharp pin at its end with the bottom of the case supporting at least two terminals, a two-arm blade substantially shaped as a hair-pin cooperating by means of the first arm thereof with the lever to move by swivelling and sliding and to bring the second arm of the blade in contact either with two terminals or, on the contrary, with only one terminal.

7 Claims, 10 Drawing Figures

ELECTRIC CIRCUIT BREAKER

This is a continuation of application Ser. No. 760,510 filed Jan 19, 1977, now abandoned.

This invention relates to an electric circuit breaker, operable at low voltage, with a very simplified design in order to obtain a moderate cost but high quality product.

According to this invention, a two-arm blade having substantially the shape of a hair-pin, cooperates by means of the first arm thereof with a lever to follow a rocking motion and to bring the second arm of the blade in contact either with two terminals or, on the contrary, with only one terminal.

According to another feature of this invention, the blade comprises a lower flat arm, extended in one direction by a portion shaped as an inverted L, the lower flat arm being connected to the second arm by an arcuate portion and the second arm having a free end terminated substantially as a V and placed above the lower arm before the inverted L portion.

Various other features of this invention will appear from the following detailed description.

Embodiments of this invention are shown as non-limitative examples in the enclosed drawings, wherein.

Figure 1:
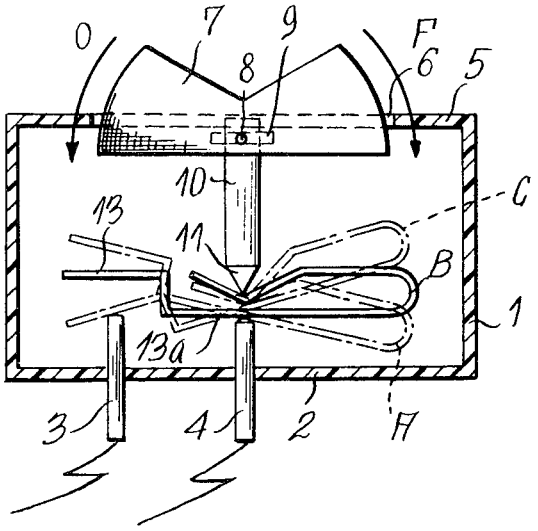
FIG. 1 is a partly sectional elevation view of the circuit breaker of this invention.
Figure 2:
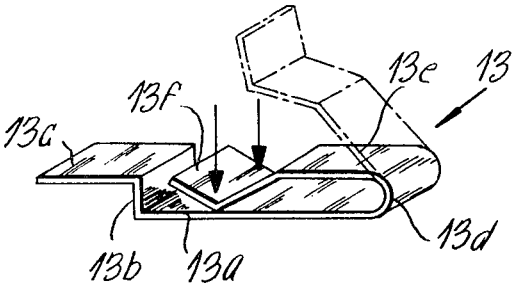
FIG. 2 is an enlarged isometric view of an element of the circuit breaker.

In FIG. 1, a parallelepipedal case 1 is illustrated, with a bottom 2 supporting at least two terminals 3, 4, but in most cases four terminals located two by two in the same plane as each terminal 3, 4.

The terminals 3, 4 extend considerably beyond the upper and lower sides of the bottom portion 2, which bottom portion is provided with means for securing these terminals.

The top portion 5 of the case 1 comprises a central opening 6 through which can pass a rocking lever 7 pivotally mounted on the case 1 by means of pivots 8 resting in recesses 9 provided in inner walls of the case 1.

The rocking lever 7 is extended, at its lower part, by one or two pins 10 having a sharp lower end 11.

Between each pin 10 and the terminals 3, 4 is installed a blade 13 substantially in the shape of a hair-pin, thus cooperating with the end 11 of the pin 10 and with at least two terminals 3, 4. The blade 13 comprises a straight arm 13*a* which can be terminated, at one end, by a horizontal L shaped portion 13*b*, 13*c*, while the second end of the arm 13*a* is rounded, at 13*d*, to be extended by a plane portion 13*e*, itself ended by a V shaped portion 13*f*.

This blade 13, which is made in a good electrically conducting metal has, because of its shape, a very great resiliency and can thus be easily distorted. When the lever 7 follows the direction of the arrow O (FIG. 1) the blade 13 will then slivel while sliding toward the rear of the case 1, into a position A, and will then open the electrical circuit since the blade 13 rests only on the contact 4. In this case, the end 11 of the pin 10, located in the V shaped portion 13*f*, has pushed back the blade 13 into the position A.

When the rocking lever 7 is swivelled into the direction of the arrow F (Fig. 1), the blade can first be in position B, then in position C, which thus ensures an electrical connection between the contact terminals 4 and 3.

The resiliency of the blade 13 ensures a sudden circuit break, and prevents the contacts to be fouled by sparkling, since every break causes a fast self-cleaning of the electrical connecting components due to the sliding movement of the blade 13 on the terminals 3 and 4.

Mounting of the circuit breaker is very simplified since it is sufficient to place at least one spring blade 13 in the position A (FIG. 1) then to install the rocking lever 7 in the case 1, for the circuit breaker to be terminated.

In the preceding disclosure, there has been described a circuit breaker which comprises only two contacts 3, 4 and one blade 13, but two-or three-pole circuit breakers can be manufactured in the same way.

Figure 3:
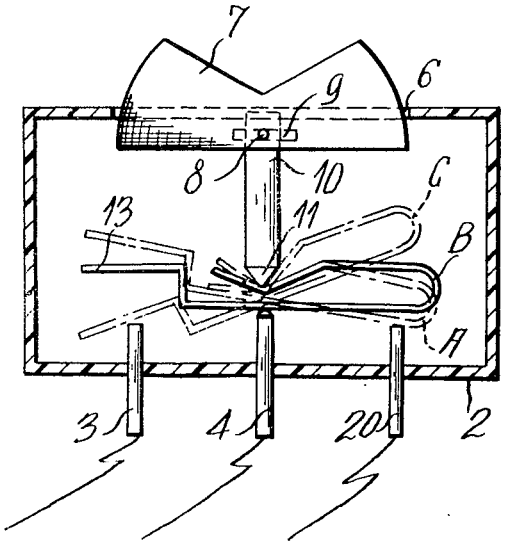
FIG. 3 is a sectional side elevation view of an electric breaker-switch assembly obtained through a variant of the invention.

It is also possible to realize, as shown in FIG. 3, an inverter-breaker assembly by providing a series of contacts 3, 4, 20 in the bottom portion 2 of the case 1.

Depending on the position of the rocking lever 7, the contact 4 is connected by the blade 13 either with the contact 3 (position C) or with the contact 20 (position A).

In all cases, the blade 13, which is substantially in the shape of a hair-pin, is sized in relation with the number of operations to be achieved, in order to obtain a very long duty life.

Figure 4:
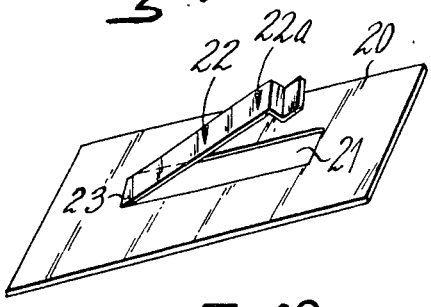
FIG. 4 is an isometric view of a variant of the blade forming the moving part of the circuit breaker of this invention.

In FIG. 4, the blade 20, of a rectangular shape, comprises in its center, a cut 21 which delimits a tongue 22, said tongue 22 being foldable along the folding line 23. The end 22*a* of the tongue 22 has been shaped substantially in a V form to receive the sharp portion 24 of a rod 25 of a control lever 26, articulated in 27 in a case 28 of the circuit breaker (FIGS. 5, 6, 7).

Figure 5:
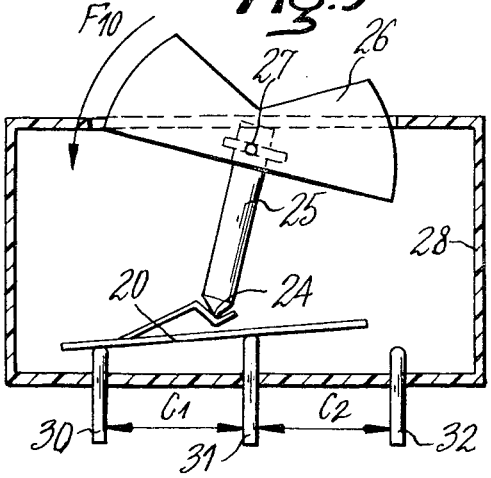
FIGS. 5, 6, 7 show the blade of FIG. 4, used in a circuit breaker which can also be an inverter switch.
Figure 6:
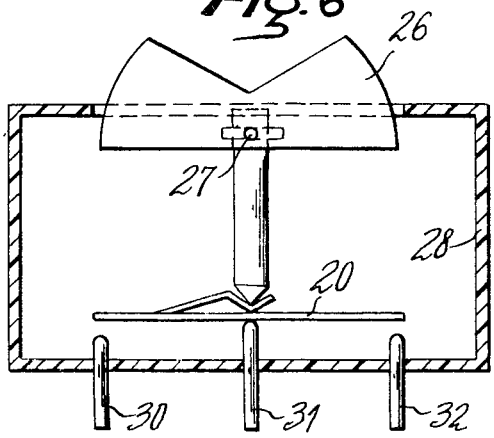
Figure 7:
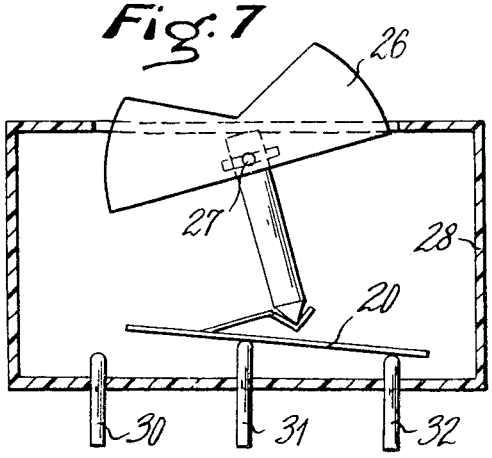

FIGS. 5, 6, 7 prefectly represent the blade 20, intended to close the circuits C1, C2 when an inverter-breaker assembly is considered or, merely the circuit C1 when the circuit C2 is not connected, i.e. when the device is used only as a circuit breaker. When the lever 26 swivels in the direction of the arrows F10 (FIG. 5), the blade 20 suddenly slides on the peaks of contacts 30, 31 while causing the fast opening of the circuit C1. The lever 26 follows its movement in the direction of the arrow F10 and at a certain moment the blade 20 will suddenly rock on the contacts 31, 32, thus providing through its sliding movement a correct rub cleaning of the tops of the contacts 32 and 31. As illustrated in the drawings, the upper portion of the contacts 30 and 32 is less high than the upper portion of the contact 31.

Generally, the blade 20 is made in a very high electrically conducting and resilient metal, for instance bronze or brass, which can be plated with a very light silver coating on its lower side which slides upon the top portions of the contacts 30, 31, 32.

Figure 8:
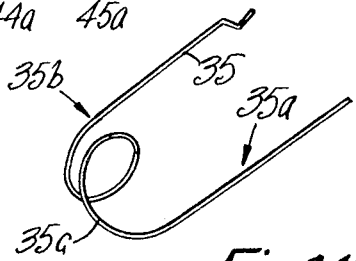
FIG. 8 shows an isometric view of a particular embodiment of a component used in the circuit breaker.

In FIG. 8, the blade has been shown as a spring 35 comprising two arms 35*a*, 35*b*, connected together by a spiral 35*c* which makes the arms 35*a*, 35*b* resilient enough to cause, on one hand, an easy and sudden sliding movement upon the contacts, and, on the other hand, a slight rotation under the effect of the sharp portion of the rod of the rocking lever controlling the circuit breaker. At every operation, the sudden closing or the sudden opening of the circuits is thus obtained together with a correct cleaning of the upper parts of the contacts, which makes the flow of the current easier. The spring 35 is generally made in a resilient and high electrically conducting bronze.

Figure 10:
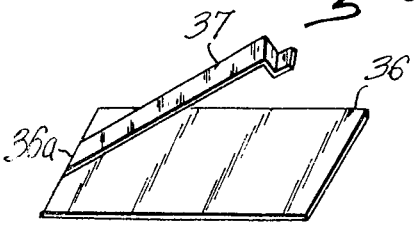
FIG. 10 is an isometric view of still another variant of the blade.

In FIG. 10, the blade 36 is practically the same as in FIG. 4, but the resilient tongue 37 has been made by cutting and is folded along the front face 36*a* of the blade 36.

Figure 9:
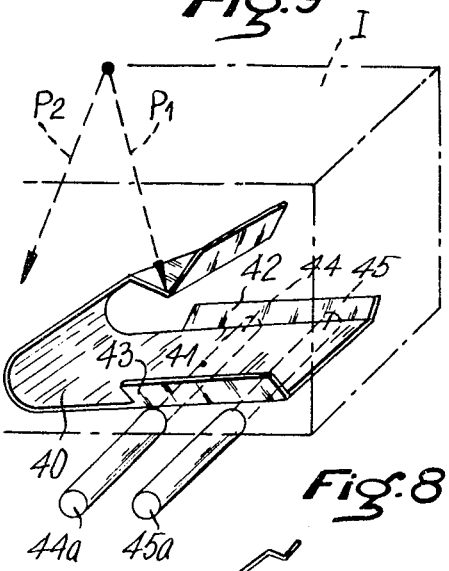
FIG. 9 is an isometric view of another variant of the blade.

Finally, in FIG. 9, the blade 40, which is substantially in the form of a folded L, has a lower sliding portion 41 connected with straightened side wings 42, 43, which then enable to use directly the stripped ends 44, 45 of conductors 44*a*, 45*a* entered through openings provided for that purpose in the case of the circuit breaker generally shown at I. The blade 40 can be moved inside the circuit breaker by sliding from a position P1 to a position P2, by means of a control lever, of the type described in the preceding figures so that the sudden sliding movement from the position P1 to the position P2 will involve opening of the circuit between the conductors 44*a* and 45*a*.

As in the preceding cases, the blade 40 is made of a good electrically conducting and very resilient metal.

I claim:

1. An electric switch comprising:

a casing with a bottom;

a rocking lever pivotally mounted in the casing, said rocking lever having at least one tapered end;

at least two terminals fixedly mounted in the bottom of said casing; and a blade of resilient material, formed as a single piece, having an upper and a lower portion, said upper portion of said blade having a shaped free end and said lower portion of said blade having a flat part, said flat part being slidingly mounted on at least one of said terminals, the said shaped free end of said blade being located essentially above the central region of the said lower portion such that, as the blade slides and swivels, the resilient material provides a spring action causing the said blade to snap into contact after sliding over center, while remaining at all times in contact with said tapered end of said pivoted lever; the tapered end of said lever engaging said shaped free end of the upper portion of said blade whereby actuation of the said pivoted lever causes the lower portion of the said blade to rotate about and to slide on at least one of said terminals and bring said lower portion of said blade into contact with another of said terminals.

2. An electric switch according to claim 1, wherein said flat part of the lower portion of said blade is extended in one direction by a part shaped like an inverted L, said flat part being connected to the upper portion of the blade by an arcuate portion, said free end of said upper portion being substantially V-shaped and being placed above said lower portion and between said arcuate portion and said inverted L-shaped part of said blade.

3. An electric switch according to claim 1, wherein said blade comprises a plate forming said lower portion, the plate being connected to a resilient straightened part forming said upper portion with, at its free end, a substantially V-shaped area for positioning said tapered end of the lever.

4. An electric switch according to claim 1, wherein said blade comprises an apertured plate forming said lower portion, the aperture of the plate having a tongue fixed onto one side of the aperture and forming said upper portion, with the free end of said tongue being substantially V-shaped.

5. An electric switch according to claim 1, wherein said blade comprises a plate forming said lower portion, the plate having an extension substantially making an acute angle with said plate, said extension forming said upper portion.

6. An electric switch according to claim 1, wherein said blade is substantially the shape of a "U", with said lower portion comprising wings usable as elements for connecting ends of stripped conductors.

7. In an electric switch of the type employing a casing with a bottom, at least two terminals fixedly mounted in the bottom of the casing, a rocking lever pivotally mounted in the casing, the rocking lever having at least one tapered end, and a snapover leaf spring, the improvement comprising:

a slidingly mounted leaf spring which provides snap action, said spring having an upper and a lower portion, said upper portion having a shaped free end and said lower portion having a flat part, said flat part being slidingly mounted on at least one of the terminals; said shaped free end being located essentially above the central region of said lower portion such that, as the blade snaps over, it slides along the top of at least one contact, providing a wiping action, while remaining at all times in contact with the tapered end of the lever; said lower portion making or breaking contact with at least one other of the terminals when it snaps over.

* * * * *